US007748457B2

(12) United States Patent
Walton et al.

(10) Patent No.: US 7,748,457 B2
(45) Date of Patent: Jul. 6, 2010

(54) INJECTION OF TREATMENT MATERIALS INTO A GEOLOGICAL FORMATION SURROUNDING A WELL BORE

(75) Inventors: Ian C. Walton, Sugar Land, TX (US); John W. Still, Richmond, TX (US); Alfredo Fayard, Houston, TX (US); Charles Woodburn, Marnes-la-Coquette (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 11/306,869

(22) Filed: Jan. 13, 2006

(65) Prior Publication Data

US 2007/0163775 A1 Jul. 19, 2007

(51) Int. Cl.
*E21B 43/26* (2006.01)
*E21B 43/263* (2006.01)
*E21B 43/27* (2006.01)

(52) U.S. Cl. ..... 166/308.1; 166/307

(58) Field of Classification Search ..... None
See application file for complete search history.

(56) References Cited

U.S. PATENT DOCUMENTS

| | | | | | |
|---|---|---|---|---|---|
| 2,080,875 | A | | 5/1937 | Pitzer | |
| 2,696,258 | A | * | 12/1954 | Greene | 166/63 |
| 2,696,259 | A | * | 12/1954 | Greene | 166/63 |
| 2,740,478 | A | * | 4/1956 | Greene | 166/63 |
| 3,029,732 | A | * | 4/1962 | Greene | 102/310 |
| 3,121,465 | A | * | 2/1964 | Stephens | 166/164 |
| 3,145,770 | A | * | 8/1964 | Flickinger | 166/264 |
| 3,422,760 | A | * | 1/1969 | Mohaupt | 102/313 |
| 4,391,337 | A | | 7/1983 | Ford | |
| 4,617,997 | A | | 10/1986 | Jennings | |
| 4,633,951 | A | * | 1/1987 | Hill et al. | 166/308.1 |
| 4,823,875 | A | | 4/1989 | Hill | |
| 5,101,900 | A | * | 4/1992 | Dees | 166/288 |
| 5,131,472 | A | | 7/1992 | Dees | |
| 5,295,545 | A | | 3/1994 | Passamaneck | |
| 5,355,802 | A | * | 10/1994 | Petitjean | 102/313 |
| 5,551,344 | A | * | 9/1996 | Couet et al. | 102/312 |
| 5,775,426 | A | * | 7/1998 | Snider et al. | 166/308.1 |

(Continued)

FOREIGN PATENT DOCUMENTS

GB 2359314 A 8/2001

(Continued)

OTHER PUBLICATIONS

Behrmann, L.A. and McDonald, Bryan; "Underbalance or Extreme Overbalance;" SPE Production & Facilities, vol. 14, No. 3, Aug. 1999, pp. 187-196.

*Primary Examiner*—Zakiya W Bates
*Assistant Examiner*—Angela M DiTrani
(74) *Attorney, Agent, or Firm*—Trop, Pruner, & Hu, P.C.; Kevin B. McGoff; Rodney V. Warfford

(57) ABSTRACT

Methods and systems for creating fractures in a geological formation surrounding a well bore. In one implementation, a treatment material may be disposed at the bottom of the well bore. One or more propellant apparatuses may be immersed in the treatment material and a propellant may then be burned inside a first propellant apparatus to create fractures in the geological formation.

21 Claims, 4 Drawing Sheets

U.S. PATENT DOCUMENTS

| | | | | |
|---|---|---|---|---|
| 6,082,450 | A * | 7/2000 | Snider et al. | 166/55.2 |
| 6,138,753 | A * | 10/2000 | Mohaupt | 166/250.02 |
| 6,336,506 | B2 | 1/2002 | Wesson | |
| 6,732,799 | B2 * | 5/2004 | Challacombe | 166/299 |
| 2004/0152601 | A1 * | 8/2004 | Still et al. | 507/100 |

FOREIGN PATENT DOCUMENTS

| | | |
|---|---|---|
| GB | 2406114 A | 3/2005 |
| GB | 2408057 A | 5/2005 |

* cited by examiner

INJECTION OF TREATMENT MATERIALS INTO A GEOLOGICAL FORMATION SURROUNDING A WELL BORE

BACKGROUND

1. Field of the Invention

Implementations of various technologies described herein generally relate to production of hydrocarbons from a borehole, and more particularly, to perforating and fracturing a geological formation surrounding a borehole.

2. Description of the Related Art

The following descriptions and examples are not admitted to be prior art by virtue of their inclusion within this section.

One common technique for perforating and fracturing a geological formation to stimulate production may include the steps of penetrating a production zone with a projectile and hydraulically pressurizing the borehole to expand or propagate the fractures initiated by the projectile. Typically, pressure around a production zone in the borehole may be increased by pumping fluids into a portion of the borehole to obtain the high pressures necessary to expand the fracture in the production zones. Consequently, this technique may prove to be extremely expensive due to the preparation required for pressurizing that portion of the borehole.

SUMMARY

Described here are implementations of various technologies for a method for creating fractures in a geological formation surrounding a well bore. In one implementation, a treatment material may be disposed at the bottom of the well bore. One or more propellant apparatuses may be immersed in the treatment material and a propellant may then be burned inside a first propellant apparatus to create fractures in the geological formation.

Described here are also implementations of various technologies for a system for creating fractures in a geological formation surrounding a well bore. In one implementation, the system includes a treatment material disposed at the bottom of the well bore. The treatment material may include acid, chelant, solvent, surfactant, brine, oil, enzyme and any combinations thereof. The system may further include a propellant apparatus immersed in the treatment material.

Described here are also implementations of various technologies for a propellant apparatus. In one implementation, the propellant apparatus may include a carrier, a propellant disposed inside the carrier and a treatment material imbedded inside the propellant. The treatment material may include acid, chelant, solvent, surfactant, brine, oil, enzyme and any combinations thereof. In another implementation, the propellant apparatus may include a treatment material coating an outside surface of the propellant. In yet another implementation, the propellant apparatus may include a treatment material coating an inside surface of the carrier. In still another implementation, the propellant apparatus may include a treatment material coating an outside surface of the carrier.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

As used here, the terms "up" and "down"; "upper" and "lower"; "upwardly" and "downwardly"; "upstream" and "downstream"; "above" and "below" and other like terms indicating relative positions above or below a given point or element may be used in connection with implementations of various technologies described herein. However, when applied to equipment and methods for use in wells that are deviated or horizontal, such terms may refer to a left to right, right to left, or other relationship as appropriate.

Implementations of various technologies described herein may be used to stimulate a geological formation surrounding a well bore that has been perforated by one or more perforation techniques, such as those described in commonly assigned United States Patent Application Publication No. US-2004/0099418-A1 entitled Reservoir Communication by Creating a Local Underbalance and Using Treatment Fluid, which is incorporated herein by reference. Various implementations described herein may also be used to treat perforation damage and to remove debris from tunnels created by perforation.

Figure 1:
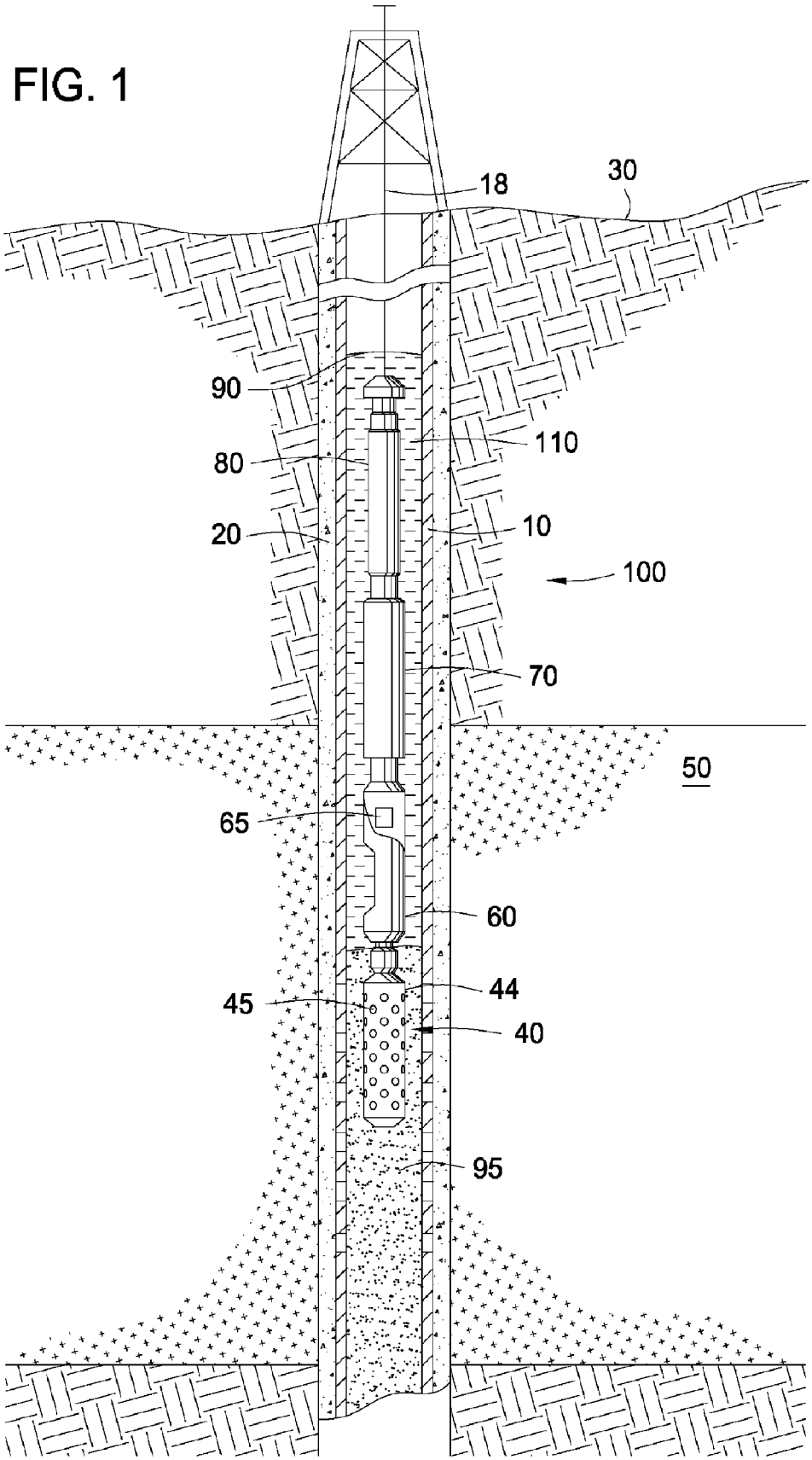
FIG. 1 illustrates a well bore in which implementations of various technologies described herein may be incorporated and practiced.

FIG. 1 illustrates a well bore 100 in which implementations of various technologies described herein may be incorporated and practiced. The well bore 100 may have a casing 10, which may be secured by means of cement 20 extending from the surface of the earth 30 to a geological formation 50 surrounding the well bore 100. A propellant apparatus 40 may be coupled to an adapter sub 60, which in turn may be coupled to a logging tool 70, which may then be coupled to a cable head 80, which in turn may be coupled to a wireline 90. The propellant apparatus 40, the adapter sub 60, the logging tool 70, the cable head 80 and the wireline 90 may all be coupled by any suitable means, such as screw threads and the like. Alternatively, slick line, coil tubing, a tubing string or any other suitable means may be used to position and support the propellant apparatus 40 within the well bore 100.

Figure 2E:
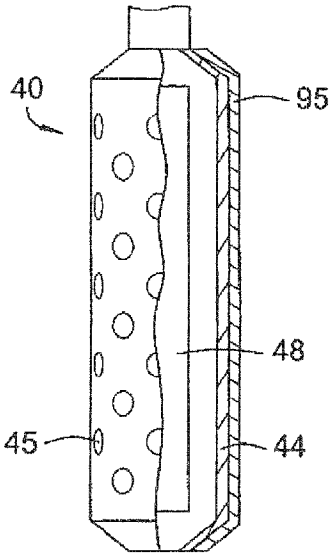
FIGS. 2A-2E illustrate various propellant apparatus implementations in accordance with various technologies described herein.
Figure 2D:
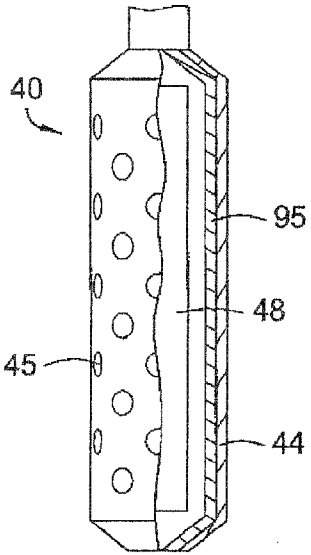
Figure 2C:
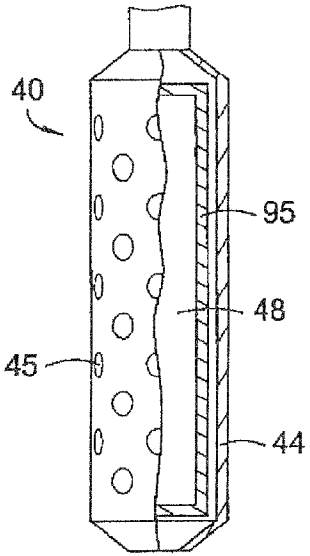
Figure 2B:
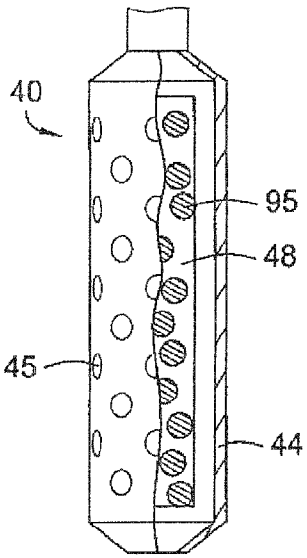
Figure 2A:
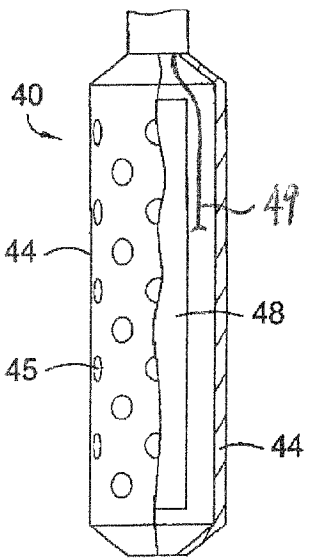

The propellant apparatus 40 may include a carrier 44 having one or more apertures 45 therethrough. FIG. 2A illustrates the propellant apparatus 40 in more detail. The apertures 45 may be uniformly or randomly spaced about the periphery of the carrier 44 and may either extend along a portion of the carrier 44 or along substantially the entire length of the carrier 44. As described here, the term aperture denotes a hole or opening through the wall of the carrier 44 which ruptures upon detonation of an ignition means, such as detonating cord 49. The carrier 44 may be formed of any metallic material, such as high grade steel and the like.

The propellant apparatus 40 may further include a propellant 48 disposed inside the carrier 44. The propellant 48 may be a relatively slow burning material. The propellant 48 may be any solid propellant having suitable burn-rate characteristics. The propellant 48 may have a burn time from about 40 ms to about several seconds.

An electrical cable (not shown) may be connected at one end thereof to the cable head 80 and at the other end thereof to a starter means, such as an electrical detonator 65, which may be positioned within the adapter sub 60. The electrical detonator 65 may be grounded to the adapter sub 60 by means of a ground wire (not shown) which may be attached to the adapter sub 60. An ignition means (not shown) may be secured to the electrical detonator 65 and extends into the propellant apparatus 40.

In one implementation, the propellant apparatus 40 may be immersed in a treatment material 95, which may include treatment liquid, such as acid, chelant, solvent, surfactant, brine, enzyme, oil and the like. The treatment material 95 may cause at least one of the following to occur: (1) achieve near-wellbore stimulation, (2) perform dynamic diversion of acid such that the amount of acid injected into each perforation tunnel is substantially the same, (3) dissolve certain minerals, (4) clean out residual skin in perforation tunnels, (5) reduce viscosity in heavy oil conditions, (6) remove surface tension within perforation tunnels and (7) enhance transport of debris, such as sand. In another implementation, the treatment material 95 may be disposed at the bottom of the wellbore 100 surrounding the propellant apparatus 40. In yet another implementation, the treatment material 95 may include proppants suspended in the treatment liquid surrounding the propellant apparatus 40 at the bottom of the wellbore 100. Proppants are configured to hold fractures open after a hydraulic fracturing treatment. Examples of proppants include naturally-occurring sand grains, man-made or specially engineered proppants, such as resin-coated sand or high-strength ceramic materials like sintered bauxite. In yet another implementation, the treatment material 95 may be imbedded inside the propellant 48, as shown in FIG. 2B, or disposed as an outside coating of the propellant 48, as shown in FIG. 2C. In still another implementation, the treatment material 95 may be disposed as a layer coating the inside surface of the propellant carrier 44 (FIG. 2D) or coating the outside surface of the propellant carrier 44 (FIG. 2E).

The treatment material may include a solid acid precursor, such as lactide, glycolide, polylactic acid (PLA), polyglycolic acid, copolymers of polylactic acid and polyglycolic acid, copolymers of glycolic acid with other hydroxy-, carboxylic acid-, or hydroxycarboxylic acid-containing moieties, copolymers of lactic acid with other hydroxy-, carboxylic acid-, or hydroxycarboxylic acid-containing moieties, and mixtures thereof. The solid acid-precursor may be mixed with a solid acid-reactive material, such as magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass. The treatment material 95 may further include water-soluble agent that accelerates hydrolysis of the solid acid precursor. Such agent may include esters, diesters, anhydrides, lactones, alkali metal alkoxides, carbonates, bicarbonates, alcohols, alkali metal hydroxides, ammonium hydroxide, amides, amines, alkanol amines and mixtures thereof. The treatment material 95 may further include an acid, such as hydrochloric acid, hydrofluoric acid, ammonium bifluoride, formic acid, acetic acid, lactic acid, glycolic acid, aminopolycarboxylic acids, polyaminopolycarboxylic acids, salts thereof and mixtures thereof. The solid acid-precursors or the mixtures of solid acid-precursors and solid acid-reactive materials may be manufactured in various solid shapes, including, but not limited to fibers, beads, films, ribbons and platelets. Other details of the treatment material 95 may be described in commonly assigned United States Patent Application Publication No. US-2004/0152601-A1 entitled Generating Acid Downhole in Acid Fracturing, which is incorporated herein by reference in its entirety. Wellbore/completion fluid 110 may be disposed above the treatment material 95, which has greater density than the wellbore fluid.

Figure 3:
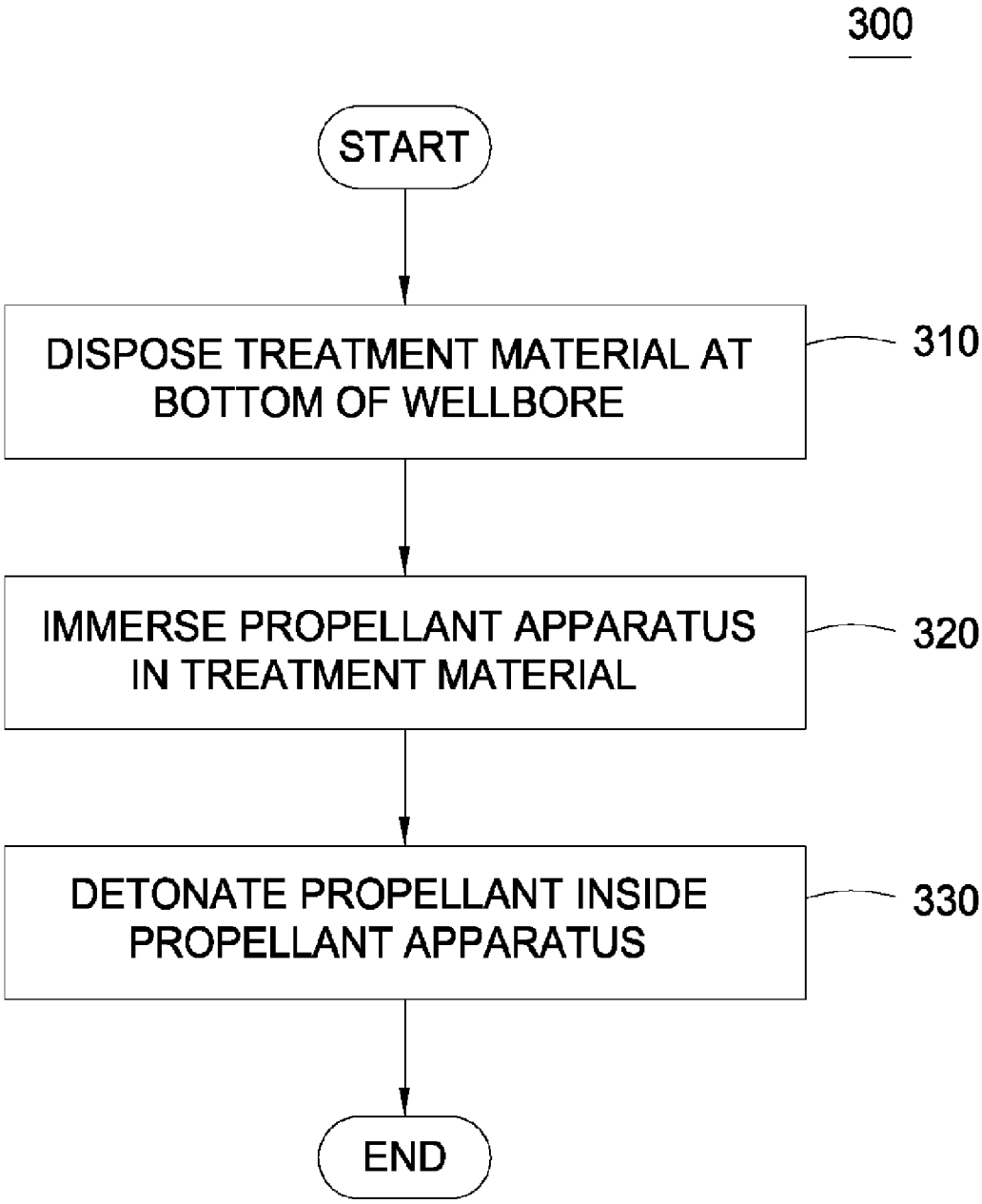
FIG. 3 illustrates a flow diagram of a method for creating fractures in a geological formation surrounding a well bore in accordance with various technologies described herein.

FIG. 3 illustrates a flow diagram of a method 300 for creating fractures in a geological formation surrounding a well bore in accordance with various technologies described herein. At step 310, the treatment material 95 is disposed at the bottom of the well bore 100. The treatment material 95 may be in various forms and include various chemicals as described in the above paragraph. At step 320, a propellant apparatus 40 may be lowered into the bottom of the well bore 100 until it is completely immersed in the treatment material 95. At step 330, the propellant 48 may be detonated using the electrical detonator 65 or any other means that may detonate the propellant 48 inside the well bore 100. High pressure gases generated by the burning propellant 48 create fractures in the geological formation 50 and drive the treatment material 95 into these fractures. In this manner, the treatment material 95 may be delivered into the geological formation 50 during a propellant burn. The detonation process may be described in more detail in commonly assigned U.S. Pat. No. 5,355,802 entitled Method and Apparatus for Perforating and Fracturing in a Borehole, which is incorporated herein by reference.

Figure 4:
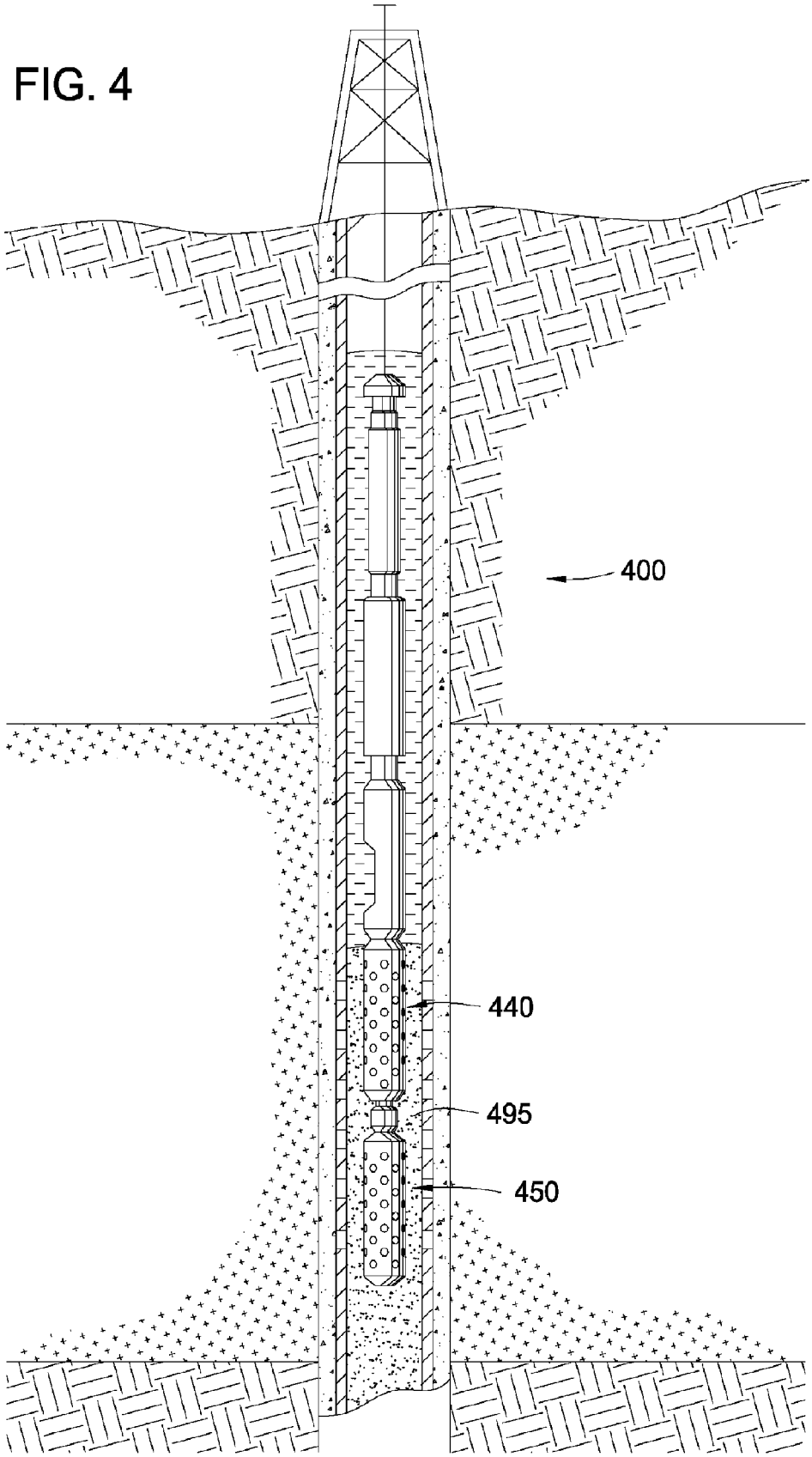
FIG. 4 illustrates a well bore in which implementations of various technologies described herein may be incorporated and practiced.

Although implementations of various technologies described herein are with reference to a single propellant apparatus 40, it should be understood that implementations of various technologies described herein are not necessarily limited to using one propellant apparatus. In fact, any number of propellant apparatus may be used by implementations of various technologies described herein. For example, FIG. 4 illustrates a well bore 400 in which propellant apparatus 440 and propellant apparatus 450 may be disposed at the bottom of the well bore 400. Both propellant apparatus 440 and propellant apparatus 450 may be completely immersed in a treatment material 495. In one implementation, propellant apparatus 450 may be detonated, followed by detonating propellant apparatus 440 after a predetermined time delay. The combustion by propellant apparatus 440 may be configured to exert high pressure gases in a downward direction toward propellant apparatus 450 and toward the fractures that were already opened by the combustion caused by propellant apparatus 450. A packer (not shown) may be placed above propellant apparatus 440 to limit the flow of high pressure gases in an upward direction.

Implementations of various technologies described herein may have many advantages, including stimulation of the near-wellbore region. Fractures induced by propellant combustion may provide a conductive path from the well bore 100 through a damaged zone to the virgin matrix, thereby providing a path through which the treatment material 95 may be delivered. The speed of the treatment may facilitate good zone coverage. In one implementation, the treatment material 95 reacts with the rock matrix to increase conductivity. Implementations of various technologies described herein may be seen as an end in itself or as a means of breaking down the resistance to full acidization or fracture treatment. The propellant-induced fractures allow the conductive wormholes created by the treatment material 95 to start further out from the wellbore 100 in a more permeable rock.

Another advantage pertains to situations dealing with carbonate reservoirs. In such situations, it may be desirable to apply acid into the perforation tunnels. Conventionally, diversion of such acid occurs such that the acid flows unequally into the various perforation tunnels, due to the fact that the acid tends to flow more to paths of least resistance. However, by timing the application substantially simultaneously with the transient overbalance created by the propellant burn, a more uniform distribution of acid into the perforation tunnels may be achieved. The injection of acid into each perforation tunnel provides near-wellbore stimulation, which may enhance subsequent cleanup operation.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for creating fractures in a geological formation surrounding a well bore, comprising:

disposing at least one propellant apparatus downhole, the at least one propellant apparatus having a carrier;

disposing a propellant entirely inside the carrier;

disposing a treatment material inside the carrier;

detonating an ignition element provided with the propellant apparatus to rupture at least one aperture in the carrier, wherein the treatment material is disposed inside the carrier prior to detonation of the ignition element;

burning the propellant inside the at least one propellant apparatus to elevate pressure in the well bore to create fractures in the geological formation; and delivering the treatment material through the at least one aperture into the fractures while the propellant is burning, wherein the treatment material comprises a solid acid precursor.

2. The method of claim 1, wherein delivering the treatment material into the fractures is in response to the elevated pressure produced by gases generated by the burning propellant.

3. The method of claim 1, wherein the treatment material further comprises proppants.

4. The method of claim 1, further comprising burning a propellant inside a second propellant apparatus a predetermined time period after burning the propellant inside the at least one propellant apparatus.

5. The method of claim 1, comprising embedding the treatment material inside the propellant.

6. The method of claim 1, comprising coating an outside surface of the propellant with the treatment material.

7. The method of claim 1, wherein detonating the ignition element comprises detonating a detonating cord.

8. The method of claim 1, further comprising coating an inner surface of the carrier with the treatment material.

9. The method of claim 1, wherein the treatment material further comprises a solid acid-reactive material mixed with the solid acid precursor.

10. The method of claim 9, wherein the solid acid precursor is selected from the group consisting of lactide, glycolide, polylactic acid (PLA), polyglycolic acid, copolymers of polylactic acid and polyglycolic acid, copolymers of glycolic acid with other hydroxy-, carboxylic acid-, or hydroxycarboxylic acid-containing moieties, copolymers of lactic acid with other hydroxy-, carboxylic acid-, or hydroxycarboxylic acid-containing moieties, and mixtures thereof, and wherein the solid acid-reactive material is selected from the group consisting of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass.

11. The method of claim 1, wherein the solid acid precursor is selected from the group consisting of lactide, glycolide, polylactic acid (PLA), polyglycolic acid, copolymers of polylactic acid and polyglycolic acid, copolymers of glycolic acid with other hydroxy-, carboxylic acid-, or hydroxycarboxylic acid-containing moieties, copolymers of lactic acid with other hydroxy-, carboxylic acid-, or hydroxycarboxylic acid-containing moieties, and mixtures thereof.

12. A system for creating fractures in a geological formation surrounding a well bore, comprising:

a carrier having an inner space containing a propellant, wherein the propellant is entirely located within the carrier;

an ignition element in the carrier to rupture at least one aperture in the carrier; and a treatment material comprising a solid acid precursor disposed inside the carrier prior to detonation of the ignition element;

wherein the aperture enables emission of elevated pressure caused by burning of the propellant into the well bore to create the fractures in the geological formation, and wherein the treatment material is to be delivered into the fractures while the propellant is burning.

13. The system of claim 12, wherein the treatment material comprises proppants.

14. The system of claim 12, wherein the treatment material comprises proppants suspended in liquid.

15. The system of claim 12, wherein the treatment material further comprises a solid acid-reactive material mixed with the solid acid precursor.

16. The system of claim 15, wherein the solid acid precursor is selected from the group consisting of lactide, glycolide, polylactic acid (PLA), polyglycolic acid, copolymers of polylactic acid and polyglycolic acid, copolymers of glycolic acid with other hydroxy-, carboxylic acid-, or hydroxycarboxylic acid-containing moieties, copolymers of lactic acid with other hydroxy-, carboxylic acid-, or hydroxycarboxylic acid-containing moieties, and mixtures thereof, and wherein the solid acid-reactive material is selected from the group consisting of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass.

17. The system of claim 12, wherein the treatment material is embedded inside the propellant.

18. The system of claim 12, wherein the treatment material coats an outside surface of the propellant.

19. The system of claim 12, wherein the ignition element comprises a detonating cord.

20. The system of claim 12, wherein the treatment material coats an inner surface of the carrier.

21. The system of claim 12, wherein the solid acid precursor is selected from the group consisting of lactide, glycolide, polylactic acid (PLA), polyglycolic acid, copolymers of polylactic acid and polyglycolic acid, copolymers of glycolic acid with other hydroxy-, carboxylic acid-, or hydroxycarboxylic acid-containing moieties, copolymers of lactic acid with other hydroxy-, carboxylic acid-, or hydroxycarboxylic acid-containing moieties, and mixtures thereof.

* * * * *